United States Patent [19]

Wright

[11] 4,001,974

[45] Jan. 11, 1977

[54] DOOR EDGE GASKET AND ASSEMBLY

[75] Inventor: John T. Wright, Cattaraugus, N.Y.

[73] Assignee: Champion International Corporation, Stamford, Conn.

[22] Filed: Nov. 10, 1975

[21] Appl. No.: 630,297

[52] U.S. Cl. ..... 49/488; 49/490

[51] Int. Cl.[2] ..... E06B 7/22

[58] Field of Search ..... 49/490, 488, 489, 491; 52/716, 717, 718

[56] References Cited

UNITED STATES PATENTS

| | | | |
|---|---|---|---|
| 3,407,537 | 10/1968 | Urbanick | 49/490 X |
| 3,717,955 | 2/1973 | Urbanick | 49/488 |
| 3,886,686 | 6/1975 | Urbanick | 49/490 X |

FOREIGN PATENTS OR APPLICATIONS

| | | | |
|---|---|---|---|
| 213,248 | 1/1961 | Austria | 49/490 |
| 1,364,641 | 5/1964 | France | 49/488 |

*Primary Examiner*—Philip C. Kannan
*Attorney, Agent, or Firm*—Evelyn M. Sommer

[57] ABSTRACT

A resilient gasket for an over-the-road trailer door has a channel for receiving the edge of a door. The gasket lips on either side of the channel converge outwardly from the bottom of the channel and are shaped to provide tapered cavities for receiving adhesive. The distal edges of the lips are beveled inwardly to retain adhesive through capillarity. A splined rib at the bottom of the channel fits into a groove in the door edge to secure the gasket while the adhesive is applied and grooves in the bottom corners of the channel accommodate door facing overhang as well as provide a flex point for bending the lips when the adhesive is being introduced.

7 Claims, 4 Drawing Figures

DOOR EDGE GASKET AND ASSEMBLY

The present invention relates to a gasket for application to the edge of a door and to a gasket and door assembly. More particularly, the present invention is concerned with an improvement in the sealing gasket applied to the edge of trailer doors, particularly the rear doors of over-the-road commercial truck trailers.

The cross section of the gasket described hereinafter is generally H-shape. Heretofore, such gaskets have been applied to the doors by inserting the edge of the door in the channel formed between opposing legs on one side of the H and driving wire staples through the web of the gasket, the cross bar of the H, into the edge of the door to retain the gasket in place. Caulking compound has also been applied, heretofore, to the gaskets to seal them with respect to the door edge. However, the prior method of constructing and affixing the gaskets requires time consuming and costly labor.

With the foregoing in mind, the present invention seeks to provide an improved gasket having a number of advantageous features over those used heretofore. In particular, a gasket constructed in accordance with the present invention requires less skill on the part of the assembler and is quicker to apply than prior gaskets. One aspect of the novel gasket described hereinafter is that it is secured to the door by an adhesive and the gasket is so shaped as to provide a self-checking feature for verifying adequate application of adhesive and proper distribution thereof. Better bonds are obtained as will be explained hereinafter, and need for removing excess adhesive has been eliminated.

The doors to which the subject gaskets are applied generally have a core faced with a metal panel. The metal panel or sheeting often extends beyond the edge of the core and, heretofore, has tended to cut or damage the gasket when applied to the door edge. To avoid such damage it has been necessary to remove the excess facing material by filing or other means prior to application of the gasket. This disadvantage is overcome by a further aspect of the subject invention.

In accordance with one aspect of the present invention there is provided a resilient gasket for application to the edge of a door, said gasket being formed of elastomeric material and having a channel for receiving the edge of a door with said channel being defined by opposite spaced apart lip portions extending from opposite side edges of an integrally interconnecting web portion, said lip portions, prior to assembly of said gasket to said door edge, converging outwardly from said web portion for distal engagement with opposite sides of said door when assembled thereto, and the distal edges of said lip portions are beveled inwardly toward said channel to provide a fillet forming relief for trapping adhesive between the edges of said lip portions and said door; and a seal establishing portion extending from said web portion outside of said channel.

In accordance with a further aspect of the subject invention there is provided a resilient gasket and door assembly comprising a door and an edge sealing gasket substantially as described above, and the channel adjacent the web portion being wider than the thickness of said door edge and the lip portions converging outwardly from said web portion toward corresponding distal engagement points with opposite sides of said door forming between each of said lip portions and said door a corresponding cavity tapering from said web portion toward said distal engagement point, and an adhesive substantially filling said cavities. As a further aspect, grooves are provided at the inside corners of said channel extending generally parallel to the surface of the adjacent lip portion and reducing the thickness of the web portion at the junction with the lip portion providing a hinge point of increased flexibility thereat. When said door is faced on at least one side with a panel whose edge projects beyond the core of said door said projecting edge extends into the corresponding groove in said gasket.

The invention will be better understood after reading the following detailed description of the presently preferred embodiment thereof with reference to the appended drawings in which.

Throughout the various figures of the drawings, the same reference numerals are used to designate the same or similar parts.

Figure 1:
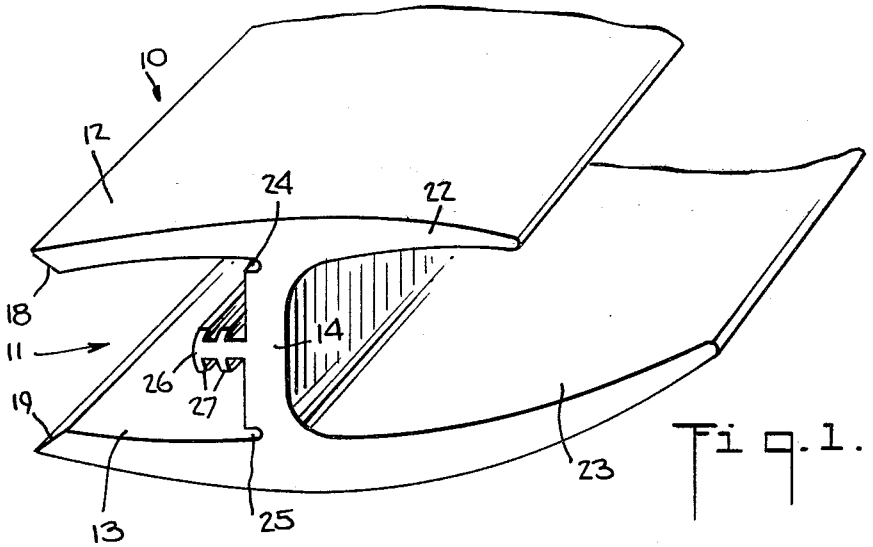
FIG. 1 is a perspective view of an end of a gasket constructed in accordance with the subject invention.
Figure 3:
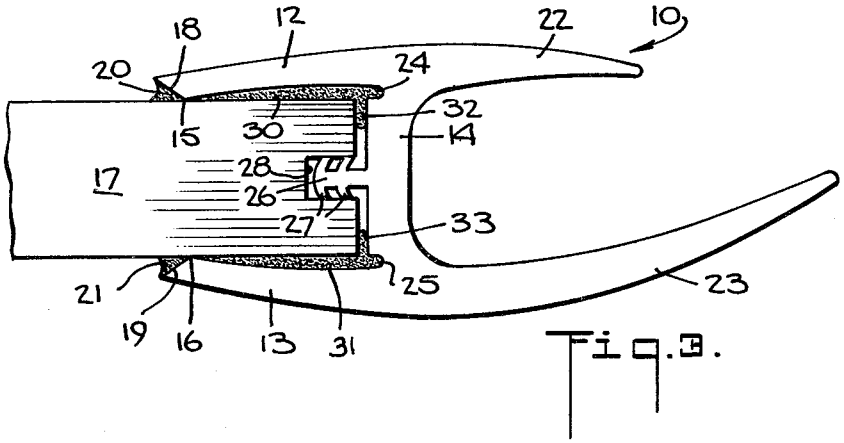
FIG. 3 is an end view similar to FIG. 2 but showing the gasket in fully assembled condition.

Referring now to the drawings and, particularly to FIG. 1 thereof, there is shown an end of a resilient gasket 10 for application to the edge of a door. The gasket 10 is formed of any suitable elastomeric material, natural or synthetic. The gasket is formed with a channel 11 for receiving the edge of a door. The channel 11 is defined by opposite spaced apart lip portions 12 and 13 extending from opposite side edges of an integrally interconnecting portion 14. The lip portions 12 and 13, prior to assembly of the gasket to a door edge, converge outwardly from the web portion 14 for distal engagement, best seen in FIG. 3, at points 15 and 16 with opposite sides of a door 17. The distal edges 18 and 19 of said lip portions 12 and 13, respectively, are beveled inwardly toward said channel 11 to provide a fillet forming relief for trapping adhesive at 20 and 21, as seen in FIG. 3. Said trapped adhesive at 20 and 21 is located between the edges 18 and 19 of said lip portions and said door 17. Seal establishing portions 22 and 23 extend from the web 14 outside of the channel 11. In the particular embodiment illustrated, the cross section of the gasket 10 is generally H-shape.

Referring further to FIG. 1, grooves 24 and 25 are provided at the inside corners of the channel extending generally parallel to the surface of the adjacent lip portions 12 and 13, respectively, and reducing the thickness of the web portion 14 at the junction with the lip portion providing a hinge point of increased flexibility thereat. A rib 26 extends from the web portion 14 within the channel 11 spaced from the lip portions 12 and 13 and provided with lateral fins 27 for retention of the gasket when the rib 26 is inserted within the longitudinal groove 28 formed in the edge of the door 17.

Figure 2:
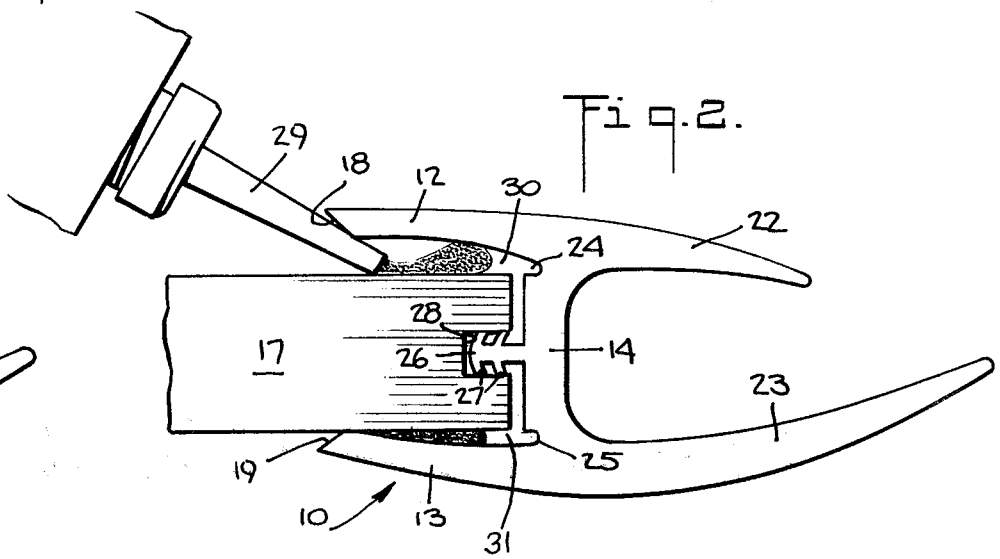
FIG. 2 is an end view of the gasket partially assembled to the edge of a door showing an intermediate step in the assembly thereof.

FIGS. 2 and 3 illustrate steps in the assembly of gasket 10 to the edge of the door 17. As shown in FIG. 2, a quantity of adhesive has already been placed below the lip portion 13 between the latter and the surface of the door 17. A separate quantity of adhesive is being placed beneath the lip portion 12 by a suitable applicator 29. It will be observed that the lip portion 12 has been raised from the door surface with the portions 12 and 22 rocking or bending as a unit about a fulcrum located generally adjacent the groove 24.

After application of the adhesive beneath the lip portion 12, the latter will be released and will bear down upon the quantity of adhesive spreading it to fill the cavity 30 formed between the lip portion 12 and the door 17. The previously applied adhesive within the cavity 31 is shown in the process of being spread due to pressure of the lip portion 13. When spreading has been completed the assembly will look somewhat as shown in FIG. 3 wherein the adhesive has spread in both directions both into the grooves 24 and 25 and out beyond the points of contact 15 and 16 to fill the fillet spaces 20 and 21. Capillarity prevents the adhesive from exiting from the regions 20 and 21 in known manner. Furthermore, adhesive will flow to a slight extent around the edge of the door between such edge and the web portion 14 to partially fill the spaces at 32 and 33. It will be understood that the splined or finned rib 26 will retain the gasket on the edge of the door due to interaction with the groove 28, while the gasket is being bent to introduce the adhesive under the lips 12 and 13.

Figure 4:
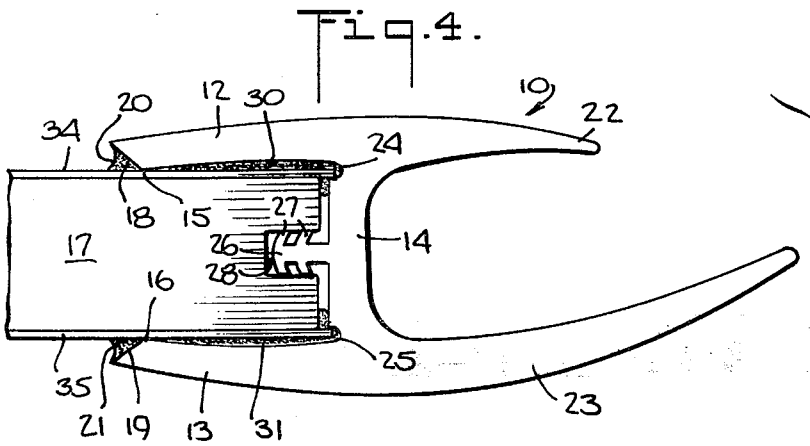
FIG. 4 is an end view similar to FIG. 3 but showing the gasket assembled to a door having facing members which project beyond the edge of the door core.

As shown in FIG. 4, the door 17 is clad with metal or other protective sheet material 34 and 35 whose edges project beyond the end of the door into the grooves 24 and 25 in the gasket.

From a consideration of FIGS. 3 and 4 it will be appreciated that the width of the channel 11 in the gasket adjacent the web portion 14 is greater than the thickness of the door 17 whereby cavities 30 and 31 are formed tapering toward the distal edge of each of the lip portions 12 and 13.

It should now be apparent that the shaping and dimensioning of the gasket 10 relative to the door 17 is such that capillarity shapes and retains the adhesive preventing messy squeeze out of any surplus. By observing the fillet formed at 20 and 21, it is possible to maintain a quality control check on the adequacy of the adhesive. Less skill is required in applying the adhesive as a consequence. The grooves 24 and 25 in the gasket prevent the gasket from being cut by the metal or other facing material on the door panel core 17. Cutting of the gasket weakens the shape and produces a defective seal. The grooves also allow the adhesive to run over the edge of the door as described above and to seal the door edges. This also provides a capacity for accommodating excess adhesive. A waterproof structural grade adhesive is presently preferred.

Having described the invention with reference to the presently preferred embodiment thereof, it will be understood that various changes in construction may be effected without departing from the true spirit of the invention as defined in the appended claims.

What is claimed is:

1. A resilient gasket for application to the edge of a door, said gasket being formed of elastomeric material and having a channel for receiving the edge of the door, said channel being defined by opposite spaced apart lip portions extending from opposite side edges of an integrally interconnecting web portion, said lip portions, prior to assembly of said gasket to said door edge, converging outwardly from said web portion, each said lip portion engaging said door along an intermediate point thereof, the distal end of each said lip portion defining a fillet extending outwardly from said intermediate point thereof so as to be spaced from said door, thereby enabling adhesive to be trapped between the fillets of said lip portions and said door to provide means for verifying adequate application of adhesive and proper distribution thereof; and a seal establishing portion extending from said web portion outside of said channel.

2. A resilient gasket according to claim 1, wherein the width of said channel adjacent said web portion is greater than the thickness of said door whereby a cavity tapering toward the distal edge of each of said lip portions is formed between said lip portions and said door when assembled thereto for receiving an adhesive.

3. A resilient gasket accordng to claim 1, wherein grooves are provided at the inside corners of said channel extending generally parallel to the surface of the adjacent lip portion and reducing the thickness of the web portion at the junction with the lip portion providing a hinge point of increased flexibility thereat.

4. A resilient gasket according to claim 3, wherein a rib extends from said web portion within said channel spaced from said lip portions and provided with lateral fins for retention of the gasket when said rib is inserted within a longitudinal groove in the edge of a door.

5. A resilient gasket according to claim 3, wherein the width of said channel adjacent said web portion is greater than the thickness of said door whereby a cavity tapering toward the distal edge of each of said lip portions is formed between said lip portions and said door when assembled thereto for receiving an adhesive.

6. A resilient gasket and door assembly comprising a door and an edge sealing gasket joined to an edge of said door, said gasket being formed of elastomeric material and having a channel receiving said edge of said door, said channel being defined by opposite spaced apart lip portions extending from opposite side edges of an integrally interconnecting web portion, said channel adjacent said web portion being wider than the thickness of said door edge with said lip portions converging from said web portion toward corresponding distal engagement points with opposite sides of said door forming between each of said lip portions and said door a corresponding cavity tapering from said web portion toward said distal engagement points, adhesive substantially filling said cavities, the inside corners of said channel including grooves extending generally parallel to the surface of the adjacent lip portion and reducing the thickness of the web portion at the junction with the lip portion providing a hinge point of increased flexibility thereat, said adhesive substantially fills said grooves and extends at least partially around the edge of said door between said edge and said web portion, said door being faced on at least one side with a panel whose edge projects beyond a core of said door into the corresponding groove in said gasket, and a seal establishing portion extending from said web portion outside of said channel.

7. An assembly according to claim 6, wherein the distal edges of said lip portions are beveled inwardly toward said channel providing a fillet forming relief trapping adhesive between the edges of said lip portions and said door.

* * * * *